US005669776A

United States Patent [19]

Moody et al.

[11] Patent Number: 5,669,776

[45] Date of Patent: Sep. 23, 1997

[54] CABLE CONNECTOR ASSEMBLY

[75] Inventors: Paul E. Moody, Barrington, R.I.; James M. McCarthy, Mattapoisett, Mass.; Dennis J. Langmack, deceased, late of Bristol, R.I., by Susan Langmack, administratrix; Mark V. Chester, Tiverton, R.I.

[73] Assignee: The United States of America as represented by the Secretary of the Navy, Washington, D.C.

[21] Appl. No.: 712,526

[22] Filed: Sep. 11, 1996

[51] Int. Cl.[6] ..... H01R 13/44

[52] U.S. Cl. ..... 439/138; 439/142

[58] Field of Search ..... 439/138, 142, 439/144

[56] References Cited

U.S. PATENT DOCUMENTS

| | | | |
|---|---|---|---|
| 2,566,993 | 9/1951 | Parsons | 439/352 |
| 3,620,122 | 11/1971 | Kuntz et al. | 439/138 |
| 3,793,610 | 2/1974 | Brishka | 70/252 |
| 4,176,897 | 12/1979 | Cameron | 439/138 |
| 4,176,899 | 12/1979 | Betts | 439/258 |
| 4,279,458 | 7/1981 | Knapp | 439/255 |
| 4,548,455 | 10/1985 | Ezure | 439/152 |
| 4,772,214 | 9/1988 | Stoegmueller | 439/138 |
| 4,861,282 | 8/1989 | Kobayashi et al. | 439/540.1 |
| 5,017,150 | 5/1991 | Moody | 439/197 |

*Primary Examiner*—Neil Abrams
*Assistant Examiner*—T. C. Patel
*Attorney, Agent, or Firm*—Michael J. McGowan; James M. Kasischke; Prithvi C. Lall

[57] ABSTRACT

A cable connector assembly is provided to eliminate or minimize dynamic disturbance on the body shell surface of a vehicle in motion. The vehicle includes a body shell having a recessed portion which includes a cable connector receptacle and a connector housing. The connector housing does not protrude from the vehicle and is smooth with the body shell contour. The connector housing includes a female electrical connection portion. Adjacent the connector housing in the recessed portion of the body shell is a hinged closure plate which is controlled by a compression spring. When the vehicle is at rest, an electrical cable is connected to the connector housing and the closure plate is pushed into the recessed portion of the body shell. When the vehicle is put in motion, the closure plate spring decompresses to force the closure plate to close and seal the recessed portion of the body shell. The closure plate and the connector housing form a uniform and smooth surface which blends with the contour of the body shell.

10 Claims, 2 Drawing Sheets

CABLE CONNECTOR ASSEMBLY

STATEMENT OF GOVERNMENT INTEREST

The invention described herein may be manufactured and used by or for the Government of the United States of America for any governmental purpose without payment of any royalties thereon or therefor.

BACKGROUND OF THE INVENTION (1) Field of the Invention

The present invention relates to a cable connector assembly. More specifically, the invention relates to a cable connector assembly for use with a vehicle which minimizes or eliminates hydrodynamic disturbances on the surface of the vehicle after it has been put into motion and provides a reliable cable connection when the vehicle is at rest.

(2) Description of the Prior Art

A submarine weapon system includes torpedoes maintained in launch tubes. The launch tube is sealed by a breech door. Prior to launch of the torpedo or other underwater vehicle, information and power are transmitted to the torpedo in the launch tube by a series of cables. Specifically, information and power are directed from the submarine's electrical connection box through one or more electrical cables to the breech of the launch tube which includes a breech door electrical connector. An electrical cable, referred to as the "A cable", on the interior of the launch tube is connected at one end to the breech door connector and includes at its opposite end a male connector assembly which is connected by a quick disconnect means to a female receptacle assembly attached to the torpedo. The male connector assembly of the A cable and the female receptacle assembly of the underwater vehicle are connected by a pin and socket connection means. The cable connector assembly extends outwardly and protrudes from the vehicle shell.

In operation, the cable connector assembly establishes an electrical connection between the submarine and the underwater vehicle. When the vehicle is launched from the launch tube, the A cable separates from the vehicle by the quick disconnect means of the connector assembly. In practice, the A cable and the female portion of the connector assembly can be reused with minor refurbishing.

A disadvantage of the above prior art system is the female receptacle assembly portion of the cable connector protrudes outwardly from the torpedo shell. For most existing vehicle designs, the protrusion will not significantly impact on the performance of the vehicle. However, as advanced underwater vehicle propulsion systems are developed, the hydrodynamic impact of the protruding cable connector assembly will adversely effect the vehicle performance, and therefore, be unacceptable.

The prior art discloses various types of electrical connector systems, including U.S. Pat. Nos. 2,566,993; 3,793,610; 4,176,899; 4,279,458; 4,548,455 and 5,017,150. However, none of these patents provide for a cable connector assembly which minimizes hydrodynamic impact on the torpedo while also providing a reliable cable connection assembly.

SUMMARY OF THE INVENTION

It is an object of the invention to provide a cable connector assembly which reduces or eliminates hydrodynamic impact on an underwater vehicle of the torpedo after it has been launched and also provides a reliable cable connection prior to launch.

The cable connector assembly of the invention comprises a shell with a recessed area in the shell that includes a cable connector assembly. The cable connector assembly comprises a connector receptacle and a connector housing which are inserted into the underwater vehicle and which remain in the vehicle after launch. The connector housing does not protrude from the vehicle and blends with the contour of the torpedo shell. The connector housing includes a female electrical connection portion. The cable connector assembly further includes a female quick disconnect sleeve attached to the A cable which connects to the female electrical connector portion of the connector housing. Adjacent the connector housing in the recessed portion of the shell, is a hinged closure plate which is controlled by a compression spring. When the vehicle is within the launch tube, an A cable is connected to the connector housing by an electrical pin and socket connection means and information and power are delivered to the vehicle. The vehicle closure plate is pushed into the recessed portion of the shell by a male cable connector on the end of the A cable and the spring of the closure plate is compressed. When the vehicle is launched, the male cable connector is disconnected from the connector housing by a quick release locking sleeve means. Upon separation of the A cable from the vehicle, the closure plate spring decompresses to force the closure plate to close and seal the recessed portion of the shell. The closure plate and the connector housing form a uniform and smooth contour which blends with the contour of the shell. The vehicle travels through the water without the connector housing protruding from the vehicle shell as in the prior art devices and reduces or eliminates any dynamic disturbance on the shell surface.

BRIEF DESCRIPTION OF THE DRAWINGS

A more complete understanding of the invention and many of the attendant advantages thereto will be readily appreciated as the same becomes better understood by reference to the following detailed description when considered in conjunction with the accompanying drawing wherein.

DESCRIPTION OF THE PREFERRED EMBODIMENT

Figure 1:
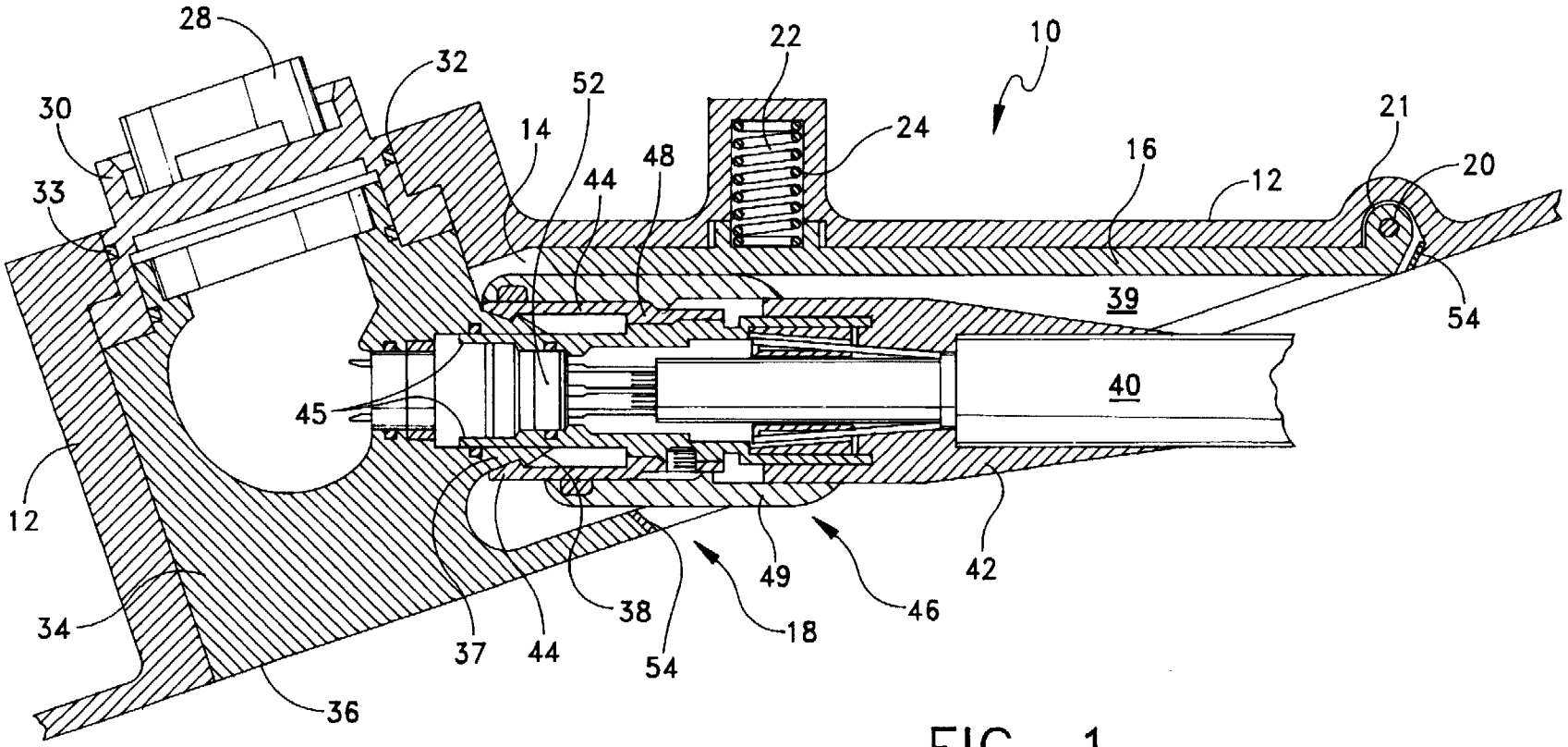
FIG. 1 is a cross sectional view of a portion of the underwater vehicle shell and the cable connector assembly with the closure plate open and the A cable connected to the vehicle.
Figure 2:
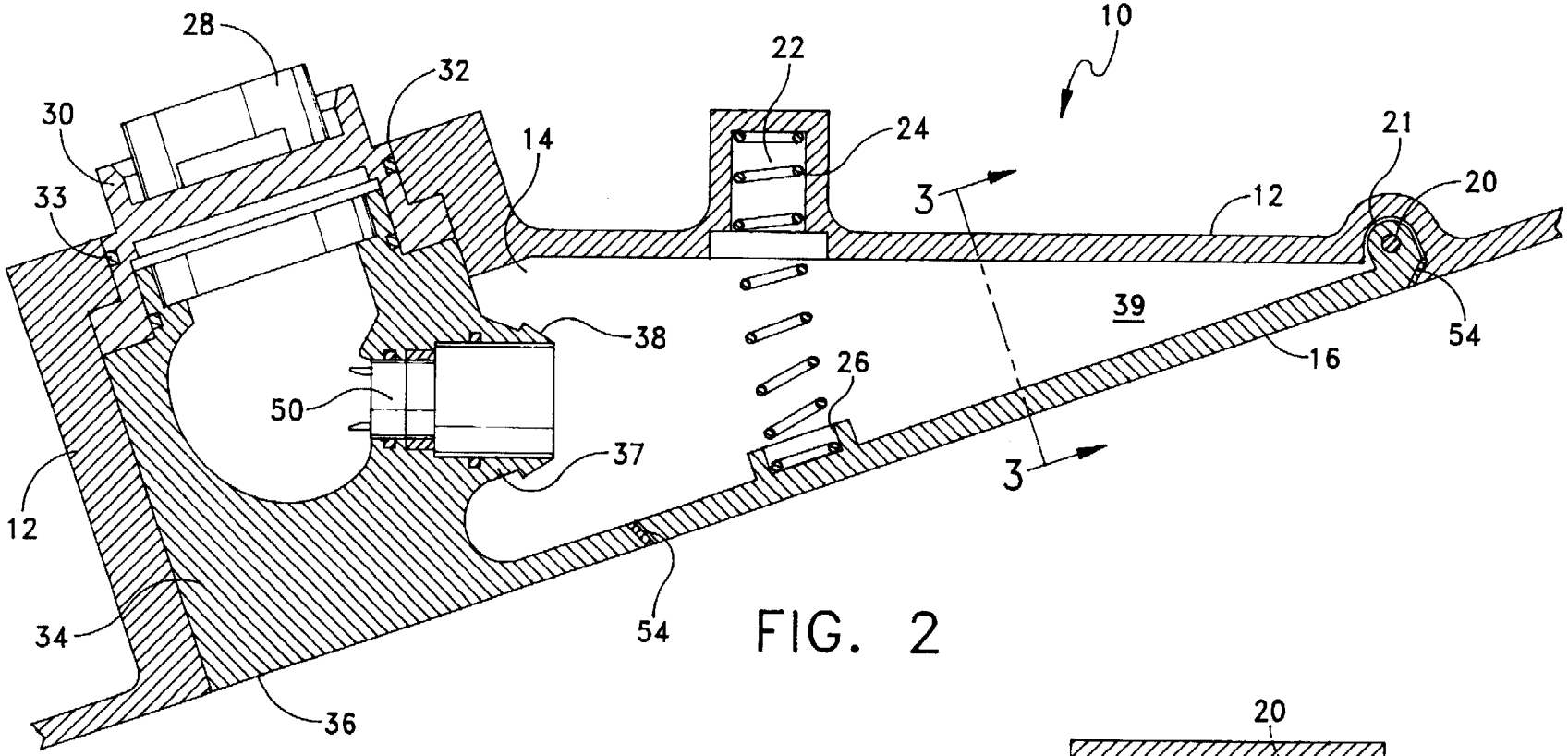
FIG. 2 is a cross sectional view of a portion of the vehicle shell and the cable connector receptacle and housing with the A cable disconnected after launch and the closure plate closed.

A preferred embodiment of the vehicle shell and cable connector assembly of the invention is generally designated 10 in FIGS. 1 and 2. The shell 12 includes a recessed area 14 connected to shell 12 is a closure plate 16. The cable connector assembly is generally designated as 18.

The closure plate 16 is connected to the shell by means of a hinge 20 or any other suitable arrangement. Hinge 20 is positioned in housing 21 of shell 12. Shell 12 includes a further housing 22 into which is inserted a compression spring 24. The underside of the closure plate 16 also includes a corresponding housing 26 for receiving the opposite end of spring 24. In the vehicle is a wiring harness 28 which is connected to the cable connector 18 through which information and power are transmitted to the torpedo.

The cable connector assembly 18 includes a connector receptacle 30 which is fitted into opening 32 in shell 12. A water tight seal is formed by any suitable means such as O-ring 33. Attached to connector receptacle 30 is connector housing 34 which is fitted in recess 14. The top surface 36 of housing 34 is smooth and blends with the surface contour shell 12. Connector housing 34 includes cable connecting means 37 having lip 38 for receiving the electrical connection cable. As best shown in FIGS. 1 and 2, the recess 14 includes an area 39 adjacent the connector housing for receiving an electrical cable 40. Cable 40 is connected to connection means 37 of connector housing 34.

In the preferred embodiment, the connector receptacle 30 and connector housing 34 of the connector assembly 18 are permanently attached to the vehicle and remain so after launch.

Cable 40 includes a housing 42, an exterior sealing sleeve 44, interior sealing sleeve 45 and a locking sleeve 46 having multiple finger members. Sleeve 44 fits over the connection means 37 and lip 38. Sleeve 45 fits inside connector means 37. Locking sleeve 46 engages lip 38 of connector means 37 to lock the cable in place. As shown in FIG. 1, for illustration purposes, locking sleeve finger member 48 is in the locked position and locking sleeve finger member 49 is in the unlocked position.

The connector housing 34 and the cable 40 each include a water blocking header 50 and 52, respectively, which preclude water from entering the torpedo and the electrical components of cable 40.

As shown in FIG. 1, when cable 40 is connected to the vehicle to transmit information and power prior to launch, the cable fits in area 39 and closure plate 16 is moved adjacent shell 12 compressing spring 24. When the vehicle is launched from the launch tube, the cable 40 disconnects from connector housing 34. Compression spring 24 decompresses and forces the closure plate 16 out from the recess 14 into a closed position in alignment with the top surface 36 of the connector housing 34 and the surface of shell 12.

Figure 3:
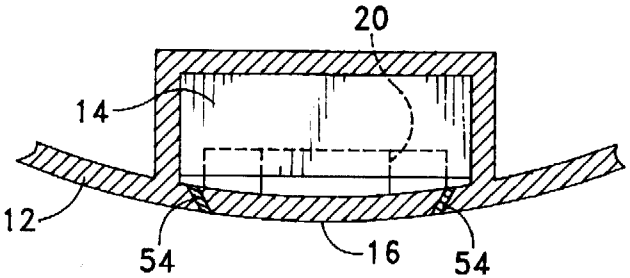
FIG. 3 is a sectional view of a portion of the vehicle shell and closure plate taken along line 3—3 of FIG. 2.

As shown in FIGS. 2 and 3, an elastomeric material 54 is coated on the edges of connector housing 34 and the shell 12 which comes into contact with closure plate 16. This material serves to eliminate metal to metal contact between the closure plate and the shell and acts as a positioning aid to ensure that the contour of the closure plate 16 and the shell 12 form a surface conducive to laminar flow at the junction area. In the alternative, the edges of the closure plate may be coated with the elastomeric material.

Accordingly, after launch of the vehicle, the vehicle surface has a smooth and uniform contour and avoids dynamic disturbance to the vehicle as it travels through the water.

As an alternative to the preferred embodiment, a latch can be provided on the closure plate for engaging the torpedo shell to further secure the closure plate in the closed position and avoid possible vibration of the closure plate after launch.

In light of the above, it is therefore understood that within the scope of the appended claims, the invention may be practiced otherwise than as specifically described. Specifically, this device can be used on a variety of devices other than torpedoes and underwater vehicles.

What is claimed is:

1. A cable connector assembly comprising:

a body having a shell and a recessed area in said shell, said recessed area having a first portion and a second portion;

a cable connection means mounted in said first portion of said recessed area and connected to said body, said cable connection means being constructed and arranged at its outermost surface to blend with the contour of said shell; and a closure plate means connected to said shell in said second portion of said recessed area and adjacent said cable connection means and having a closure plate and means for rotating said closure plate to open and close said second portion of said recessed area, said closure plate being constructed and arranged to mate with said shell and cable connection means and blend with the contour of said shell when in the closed position.

2. A cable connector assembly accordingly to claim 1 wherein said cable connection means further comprises:

a connector receptacle mounted in said body; and a cable connector housing attached to said connector receptacle and having an electrical connection means for receiving an electrical cable, and said connector housing extending outward from said recessed area and blending with the surface contour of said shell.

3. A cable connector assembly according to claim 2 wherein said means for rotating comprises a hinge means connecting said closure plate to said shell.

4. A cable connector assembly according to claim 3 wherein said means for rotating said closure plate to open and close said second portion of said recessed area further comprises a compression spring joined between said closure plate and said shell.

5. A cable connector assembly according to claim 1 wherein said means for rotating comprises a hinge means for connecting said closure plate to said shell.

6. A cable connector assembly according to claim 5 wherein said means for rotating said closure plate to open and close said second portion of said recessed area further comprises a compression spring joined between said closure plate and said shell.

7. A cable connector assembly according to claim 6 further comprising an elastomeric material coating of said connector housing and said shell where they mate with said closure plate.

8. A cable connector assembly according to claim 4 further comprising an external electrical cable that can be joined to said cable connector housing such that said closure plate is maintained open by interference with said external electrical cable.

9. A cable connector assembly according to claim 8 wherein said external electrical cable and said cable connector housing further include a disconnect connection means therebetween for disconnecting said external electrical cable from said cable connector housing when subjected to tensile forces.

10. A cable connector assembly according to claim 9 wherein said electrical connection means of said cable connector housing includes a lip and said external electrical cable includes a locking collar constructed and arranged for mating with said lip to maintain connection to said lip.

* * * * *